US009914581B2

(12) United States Patent
Gutow et al.

(10) Patent No.: US 9,914,581 B2
(45) Date of Patent: Mar. 13, 2018

(54) SPRAY CAN ATTACHABLE ACTUATOR AND BRUSH ASSEMBLY

(71) Applicants: David T. Gutow, Dublin, OH (US); Michael W. Gutow, St. Claire Shores, MI (US)

(72) Inventors: David T. Gutow, Dublin, OH (US); Michael W. Gutow, St. Claire Shores, MI (US)

( * ) Notice: Subject to any disclaimer, the term of this patent is extended or adjusted under 35 U.S.C. 154(b) by 37 days.

(21) Appl. No.: 15/174,065

(22) Filed: Jun. 6, 2016

(65) Prior Publication Data

US 2016/0362243 A1 Dec. 15, 2016

Related U.S. Application Data

(60) Provisional application No. 62/175,872, filed on Jun. 15, 2015.

(51) Int. Cl.

| | |
|---|---|
| ***B65D 83/28*** | (2006.01) |
| ***A46B 11/00*** | (2006.01) |
| ***B65D 83/72*** | (2006.01) |
| ***A46B 11/08*** | (2006.01) |
| ***A46B 13/04*** | (2006.01) |

(52) U.S. Cl.

CPC ..... *B65D 83/285* (2013.01); *A46B 11/0006* (2013.01); *A46B 11/08* (2013.01); *A46B 13/04* (2013.01); *B65D 83/72* (2013.01); *A46B 11/0017* (2013.01)

(58) Field of Classification Search

CPC combination set(s) only.

See application file for complete search history.

(56) References Cited

U.S. PATENT DOCUMENTS 3,387,911 A * 6/1968 Focht ..... A46B 11/0017 401/190
3,388,958 A * 6/1968 Johnson ..... A45D 27/04 132/290
3,981,597 A * 9/1976 Cohn ..... A46B 11/0017 222/190
4,252,455 A * 2/1981 de la Pena ..... A46B 11/0017 222/402.13
4,636,102 A * 1/1987 Drake ..... A46B 11/0017 222/402.13
5,692,846 A * 12/1997 Schwarzberg ..... A47L 23/05 401/190

* cited by examiner

*Primary Examiner* — David Walczak
(74) *Attorney, Agent, or Firm* — Williams Intellectual Property; Benjamin F. Williams

(57) ABSTRACT

A spray can attachable actuator and brush assembly includes an actuator assembly attachable overtop a valve stem of an existing aerosol canister and a brush assembly attachable to the actuator assembly. A lower portion of a seating member frictionally engages to the aerosol canister when an attachment collar is rotationally engaged thereabouts. A head member is connectable into a seating connect disposed in a top surface of the seating member whereby an interior channel engages overtop the valve stem. A brush attachment base secures into the head member to position an elongate nozzle in open communication with an outlet terminating the interior channel. A brush body is securable to the elongate nozzle, and depression of the head member thereby enables selective release of fluid depressurized from the aerosol canister for delivery into the brush body for subsequent application to an object by manual action directing the brush body.

14 Claims, 8 Drawing Sheets

SPRAY CAN ATTACHABLE ACTUATOR AND BRUSH ASSEMBLY

CROSS-REFERENCE TO RELATED APPLICATIONS

This nonprovisional application claims the benefit of provisional application No. 62/175,872 filed on Jun. 15, 2015

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Actuators for selective depressurization and controlled discharge of aerosol canisters are well known in the art. Most are generally cylindrical or cuboid bodies disposed overtop a valve stem to direct fluid depressurized when the valve stem is depressed by manual action effected upon the actuator. Most enable control of a depressurized fluid only generally in a expansive direction somewhat perpendicular to an outlet of the actuator. Application of fluid is thereby rendered by expansion in a general direction towards a targeted object. When the fluid released is a foam, colloid, gel, or other such fluid for example, discharge must be contained. Thus, for example, when applying shaving foam released from a canister, a user necessarily must use both hands—one to effect release of the foam from the aerosol canister and the other to collect the foam for subsequent application to the body. This presents numerous inefficiencies, including a need to wash the hands before commencing shaving, potential for uneven distribution of the foam to the body, or employment of an additional implement, such as a separate brush, to the body as is typical in traditional shaving arts.

What is needed is a spray can attachable actuator and brush assembly that is attachable directly overtop a valve stem of an aerosol canister in place of an existing actuator, whereby depressurized fluid released from the can is dischargeable into a brush body for application to a targeted surface or object by manual action used to direct the brush body in contact therewith, and thereby control application of the fluid released. Thus a user may apply controlled quantities of fluid to the body with a single hand without having to directly contact the fluid, for example, with the other hand.

FIELD OF THE INVENTION

The present invention relates to a spray can attachable actuator and brush assembly devised to secure to an aerosol canister in lieu of an existing actuator and enable application of fluid depressurized from the aerosol canister into a brush assembly for direct application to a surface or object by manual action effecting contact with a brush body. While the preferred embodiment of the present invention is primarily directed to the shaving arts, it should be recognized by anyone having ordinary skill in the art that other applications disposed to utilize the same technology are readily comprehended.

The present spray can attachable actuator and brush assembly, therefore, includes an actuator assembly attachable to an aerosol canister in position with an interior channel engaging the valve stem. The actuator assembly includes a seating member, securable to the neck of an aerosol canister, and a head member disposed to interconnect with the seating member and sealably engage the valve stem within the interior channel. Depression of the head member is accommodated by the seating member whereby the valve stem is depressible for selective depressurization of the aerosol canister.

A brush assembly is attachable to a cylindrical conduit disposed circumferentially bounding an outlet upon the head member. The brush assembly includes an elongate nozzle, connectable in open communication with the outlet, and a bush body connectable to the elongate nozzle, whereby depression of the valve stem effects selective discharge of fluid contents from within the aerosol canister for delivery into the brush body and thence application to an object. A user may thus apply fluid contents by manual action directing contact of the brush body with the object while effecting selective depressurization of the aerosol canister with the same hand, and without applying the fluid contents to either hand at all.

SUMMARY OF THE INVENTION

The present spray can attachable actuator assembly and brush assembly has been devised to enable conversion of any aerosol canister for discharge of fluid into a brush assembly whereby manual action effective to direct the brush assembly enables controlled application of the discharged fluid to a targeted object or surface, as desired.

The term "aerosol canister", as used herein throughout, is taken to include any pressurized container wherein depression of a valve stem enables selective and controlled depressurization of said container for the discharge of fluid contents therefrom. The term "spray can" is likewise considered.

Further, while the preferred embodiment set forth herein is directed to novelty in the shaving arts, by enabling controlled application of shaving foam directly dischargeable from an aerosol canister into a brush assembly attachable to said canister, it should be recognizable by anyone of pertinent skill in the relevant art that the present spray can attachable actuator and brush assembly may be variously devised to meet multifarious applications, wherever controlled application of pressurized fluids is desirable including, but by no means limited to, application of paints, gels, foams, oils, and other such fluids applicable to targeted surfaces and objects wherein action of a brush body is desirously effective.

The present spray can attachable actuator and brush assembly, therefore, includes an actuator assembly attachable overtop a valve stem of an existing aerosol canister in lieu of an existing actuator. A brush assembly is attachable to the actuator assembly whereby fluid depressurized from the aerosol canister is deliverable into the brush assembly for application by a user manually directing a brush body there attached. In a preferred embodiment of the present invention, a user may, therefore, attach the actuator assembly to a shaving foam aerosol canister and attach the brush assembly thereto wherefore shaving foam is deliverable into a brush body for application to the face without a user having to spray foam directly into the hands for application thereby. Thus, the brush assembly enables application of foam to the face by action of a brush body, which brush body may be adapted to resemble a standard and/or traditional shaving brush, as is traditionally rendered of badger hair, for example.

It should be readily recognized by anyone having ordinary skill in the art that while the actuator assembly, as set forth throughout this disclosure, is enabled separately with respect to the brush assembly, for ease of description as separate, attachable components, embodiments of the device are nonetheless contemplated wherein said brush assembly and actuator assembly are conjoined as a single unit. This slight difference notwithstanding, the present disclosure is directed to each component individually, for ease of explanation, for concision, and to render clarity in comprehension. Further, it is contemplated that embodiments of the present device may be practiced wherein the aerosol canister is likewise produced and packaged conjunct the actuator and brush assembly and replacement of an existing actuator is not in fact required.

The above notwithstanding, the present spray can attachable actuator and brush assembly includes an actuator assembly and a brush assembly. The actuator assembly includes a seating member devised to connect and secure atop an existing aerosol canister by action of a lower portion frictionally engaging thereto when an attachment collar, fittable over the seating portion, is rotationally applied to engage a plurality of compressible hasp members against the neck of the aerosol canister. Thus, the lower portion of the seating member is configured to frictionally engage with an aerosol canister, and is devised to be securable to aerosol canisters of differing sizes by action of the compressible hasp members, as will be described subsequently hereinbelow.

The seating portion further includes a generally cylindrical upper portion terminating at a top surface transversely terminating said upper portion. A central channel is disposed interior to the seating portion, devised to seat overtop the existing valve stem of the aerosol canister to which the device is attached, said central channel disposed to terminate at the top surface at a seating connect wherein a head member, as will be described below, releasably interconnects. The seating connect includes a cruciate seat and a securement channel, devised to guide an interior channel, disposed in the head member, into securable position in sealable contact with the valve stem, as will be described subsequently.

The head member, therefore, attaches overtop the seating member by insertion of a cruciate member, disposed bounding the interior channel, into the cruciate seat of the seating portion. At least a portion of the head member engages into the securement channel whereby the head member is securable in connection with the seating member. When the head member is secured in position connected to the seating member, the interior channel engages overtop the valve stem and depression of the head member thence conveys depressurized fluid through the interior channel for discharge out an outlet disposed outfacing from the head member.

A cylindrical conduit is disposed surrounding the outlet, said cylindrical conduit devised to enable attachment of the brush assembly, as will be described subsequently, thereto. A flattened section of the head member is disposed atop the head member proximal the cylindrical conduit for manual engagement and depression by a user, whereby fluid is dischargeable from the aerosol canister to which the device is attached.

The brush assembly includes an elongate nozzle disposed perpendicularly conjunct a brush attachment base. The brush attachment base includes a cylindrical seating section securable to the cylindrical conduit whereby the elongate nozzle is securable in open communication with the outlet and interior channel. Thus depressurization of fluid from the aerosol canister effects discharge of said fluid out the elongate nozzle.

A brush body is attachable to the elongate nozzle. The brush body is devised to fit to or about the elongate nozzle such that when fluid is discharged from the elongate nozzle it is applicable to a targeted surface or object by action of the brush body. Thus a user is enabled application of foams and gels, for example, depressurized from the aerosol canister into the brush body, whereby a user is enabled to apply shaving foam, for example, deliverable from the canister directly into the brush body and thence to the face, using only one hand.

In at least one embodiment contemplated as part of this invention a motor is incorporated into the head member to enable automated rotation of the brush body when the head member is depressed to depressurize the aerosol canister. In another embodiment of the invention, a heating element is contemplated whereby fluid discharged out the aerosol canister is heated prior to delivery to the brush body proper, whereby warmed fluid is applicable to the body of a user, as desired.

Thus has been broadly outlined the more important features of the present spray can attachable actuator and brush assembly so that the detailed description thereof that follows may be better understood and in order that the present contribution to the art may be better appreciated.

Objects of the present spray can attachable actuator and brush assembly, along with various novel features that characterize the invention are particularly pointed out in the claims forming a part of this disclosure. For better understanding of the spray can attachable actuator and brush assembly, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
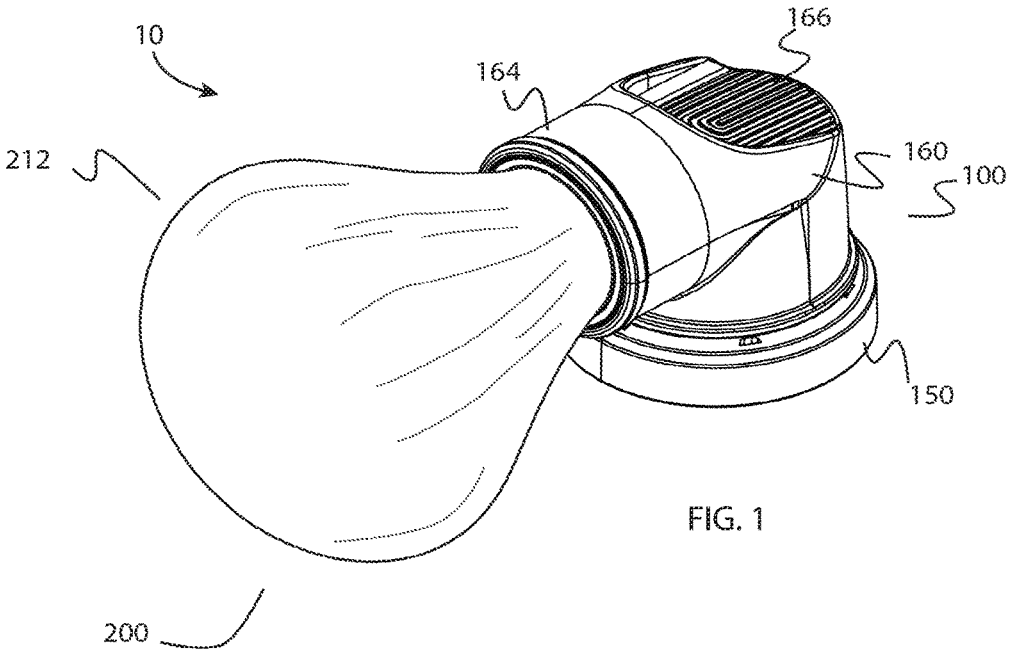
FIG. 1 is an isometric view of an example embodiment of an actuator assembly and brush assembly.
Figure 2:
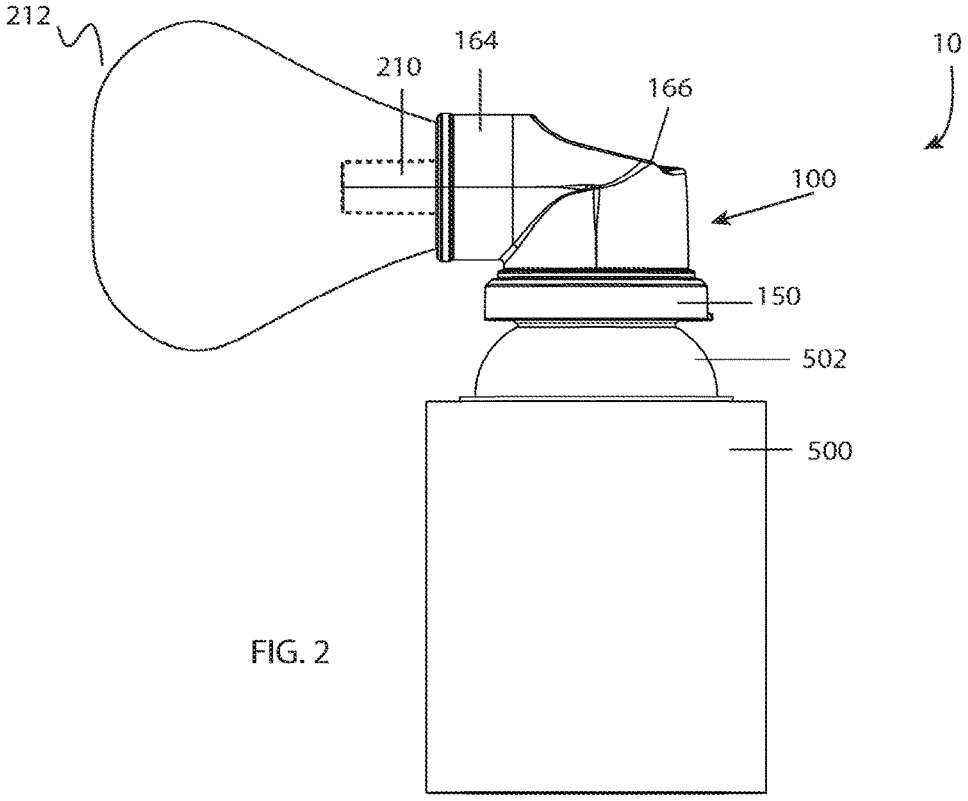
FIG. 2 is a side view of an example embodiment attached to a spray canister.
Figure 3:
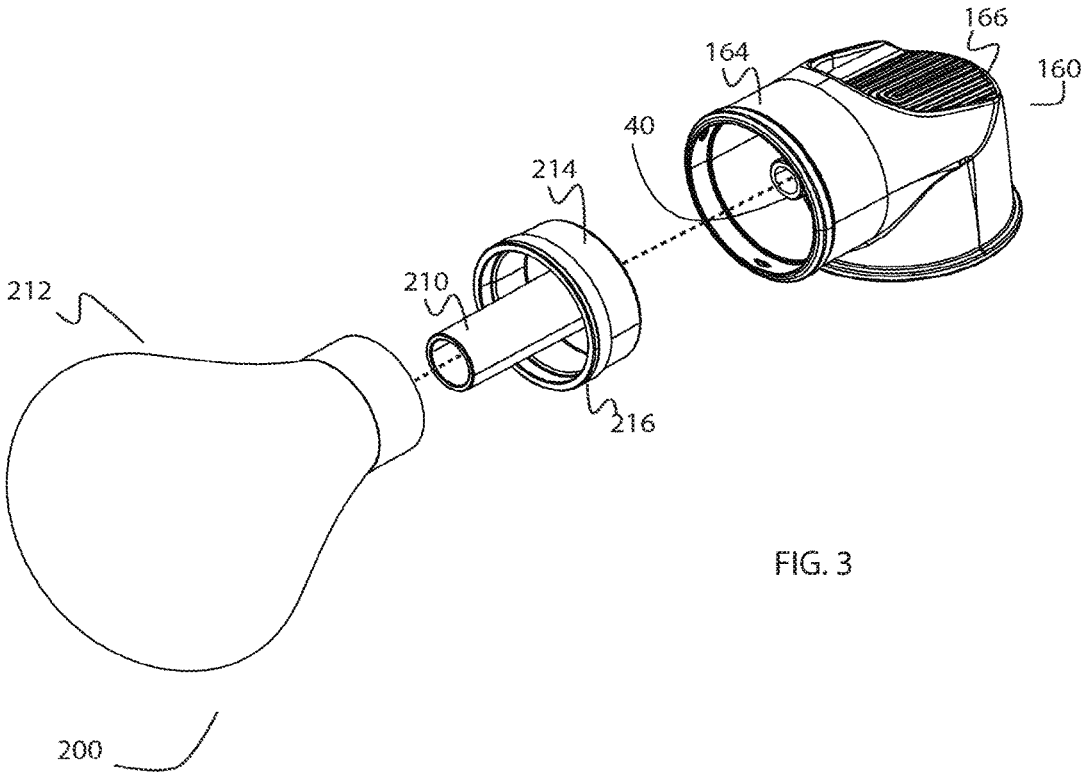
FIG. 3 is an exploded view of an example embodiment of the actuator assembly and brush assembly.
Figure 4:
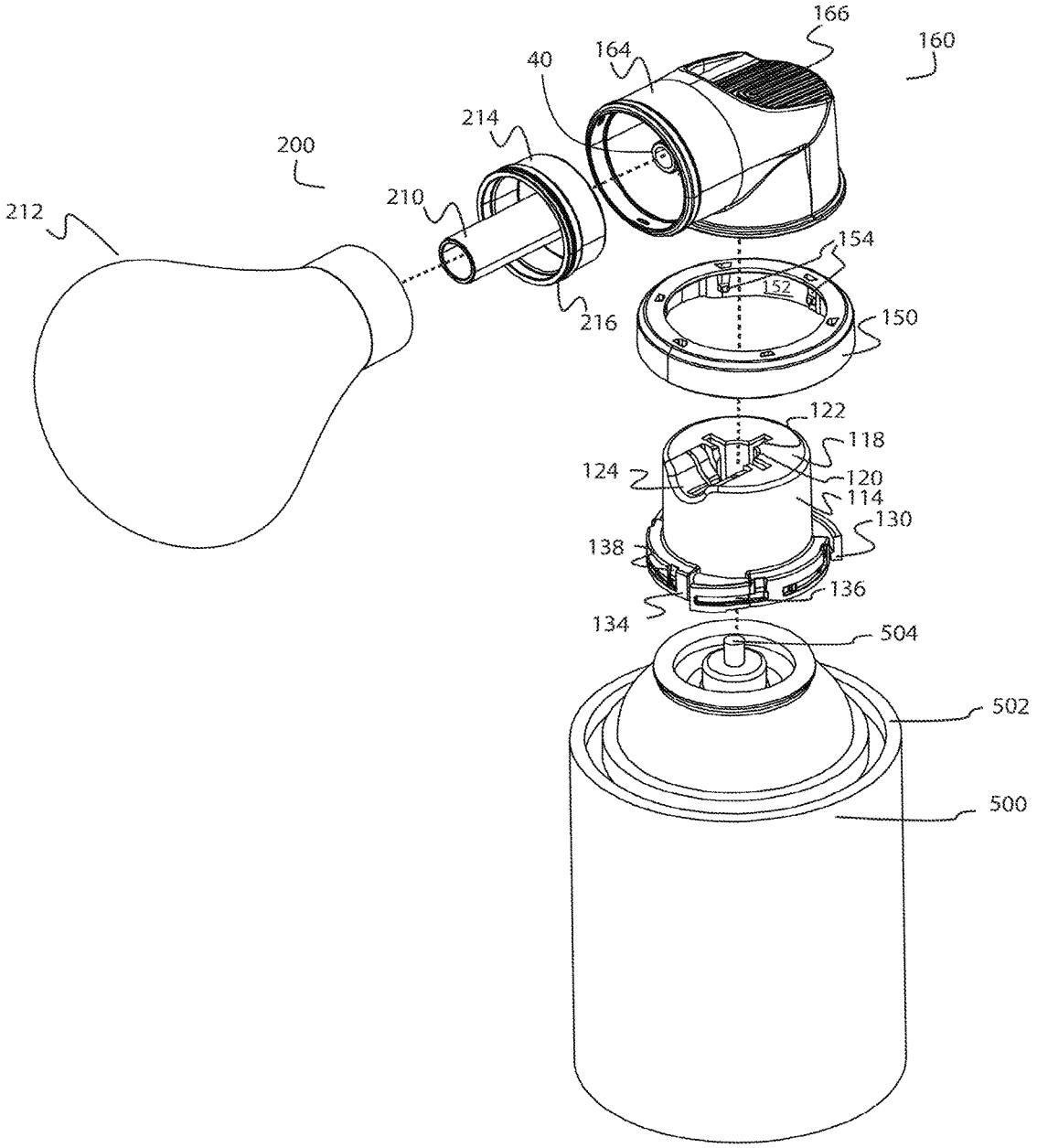
FIG. 4 is an exploded view of an example embodiment attachable to a spray canister.
Figure 5:
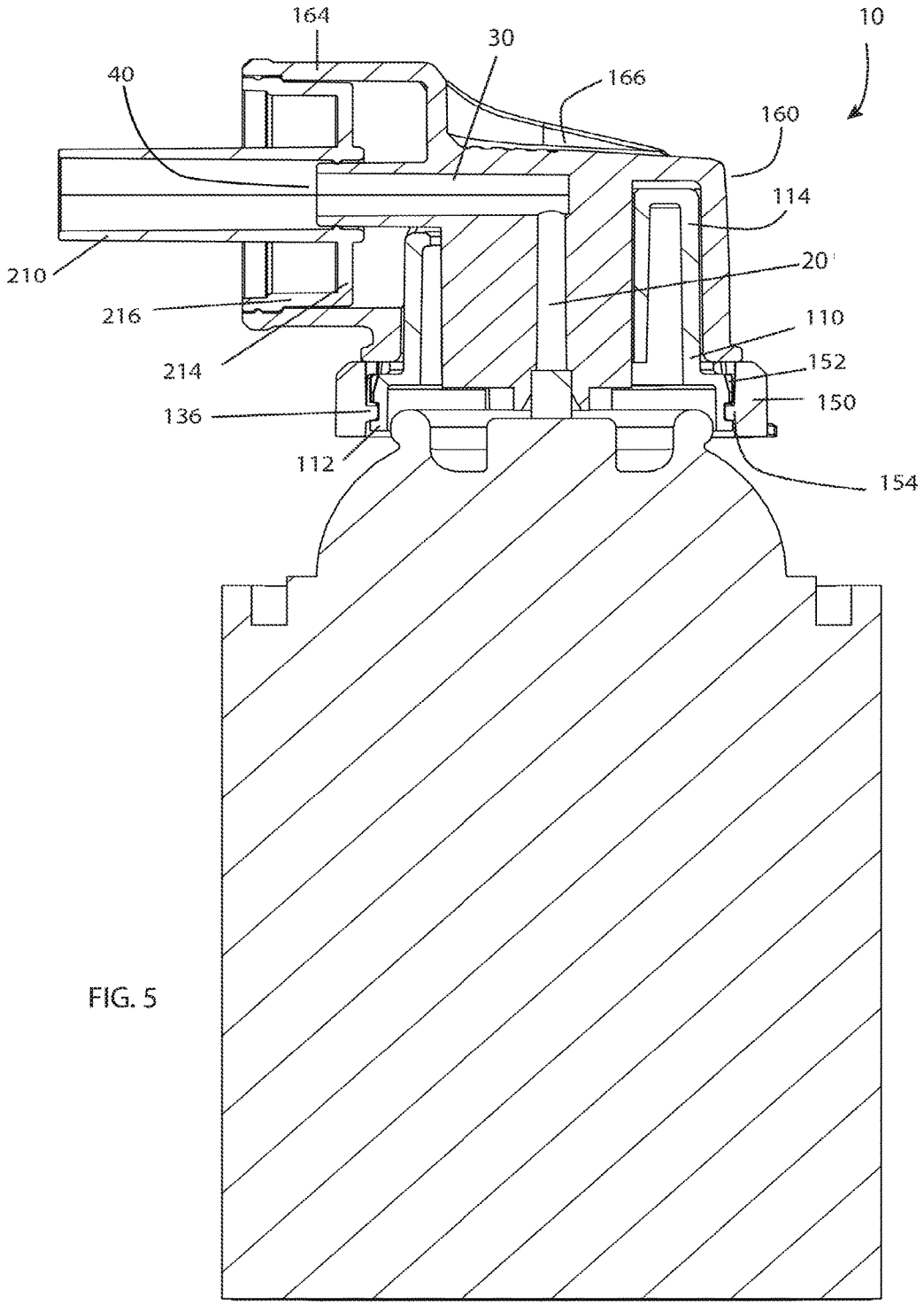
FIG. 5 is a longitudinal cross-section view of an example embodiment attached to a spray canister without a brush body attached to the brush assembly and illustrating the head member disposed in a depressed condition.
Figure 6:
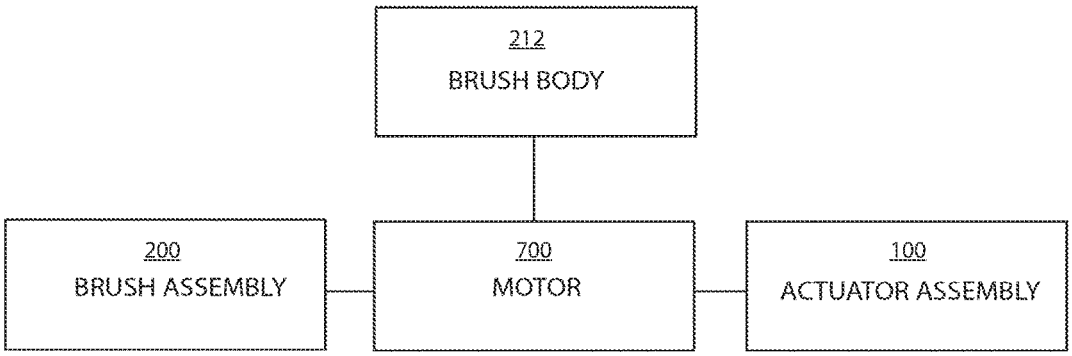
FIG. 6 is a block diagram view of an example embodiment having a motor included.
Figure 7:
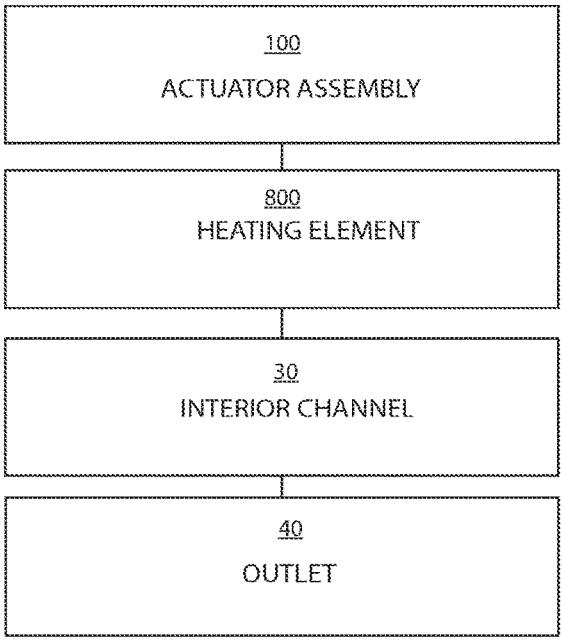
FIG. 7 is a block diagram of an example embodiment having a heating element included.
Figure 8:
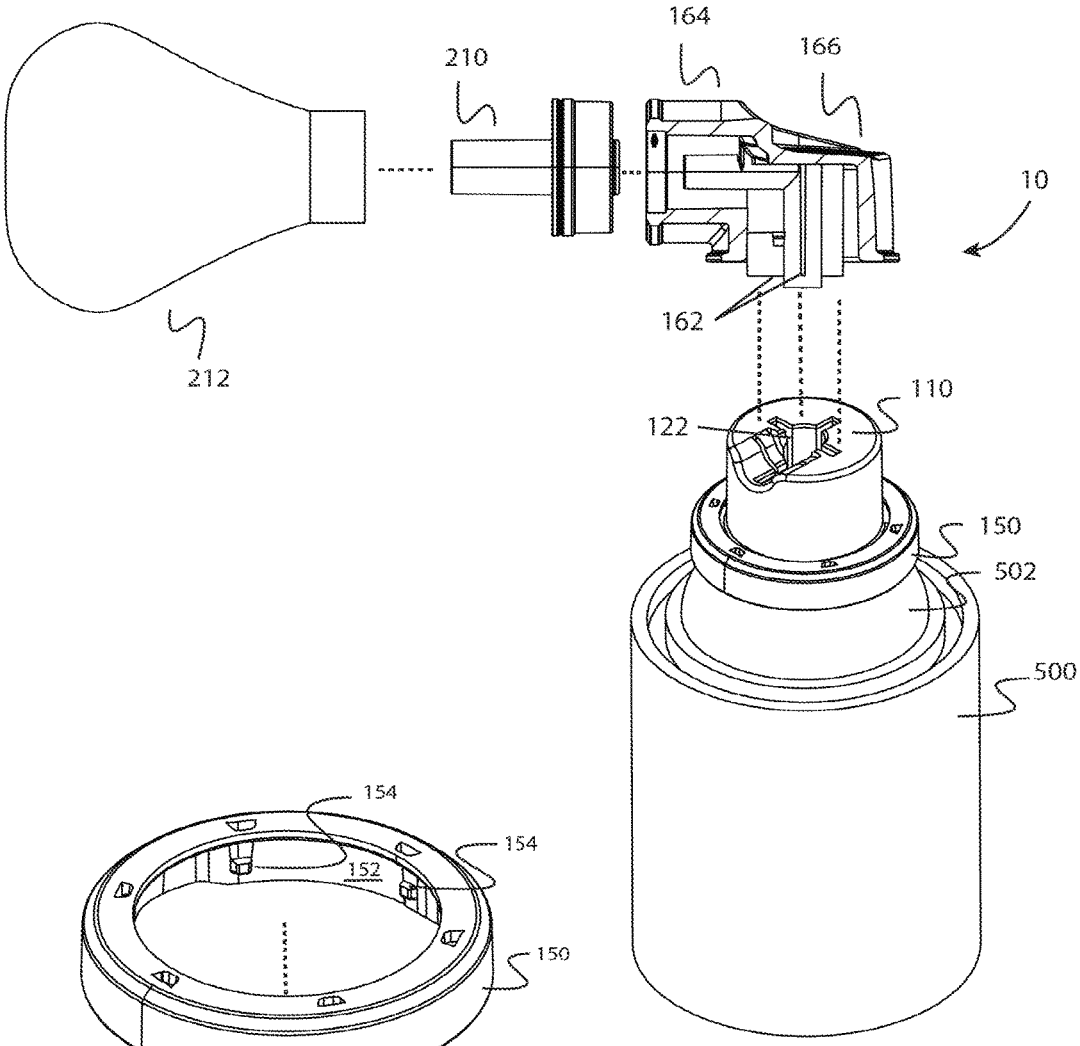
FIG. 8 is a longitudinal cross-section view of an example embodiment of a head member disposed attachable to a seating member illustrated attached to a spray canister.
Figure 9:
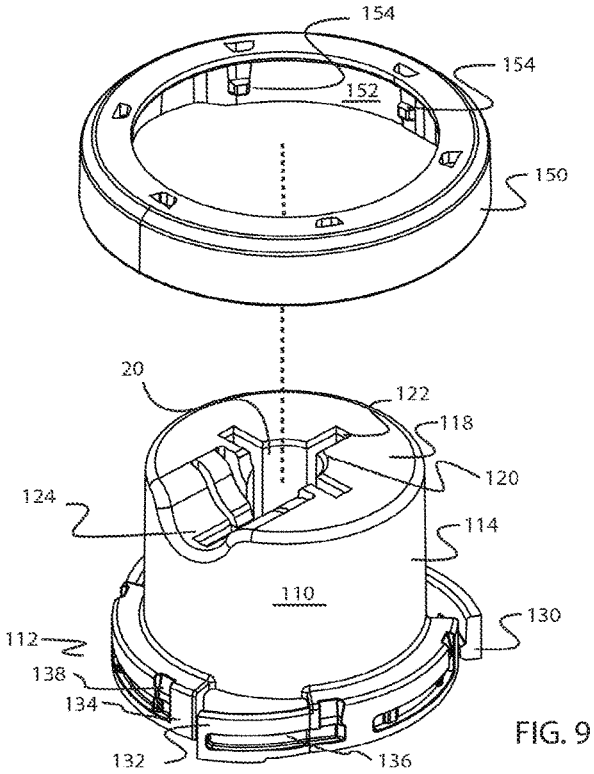
FIG. 9 is an isometric view of an example embodiment of a seating member and a corresponding attachment collar.
Figure 10:
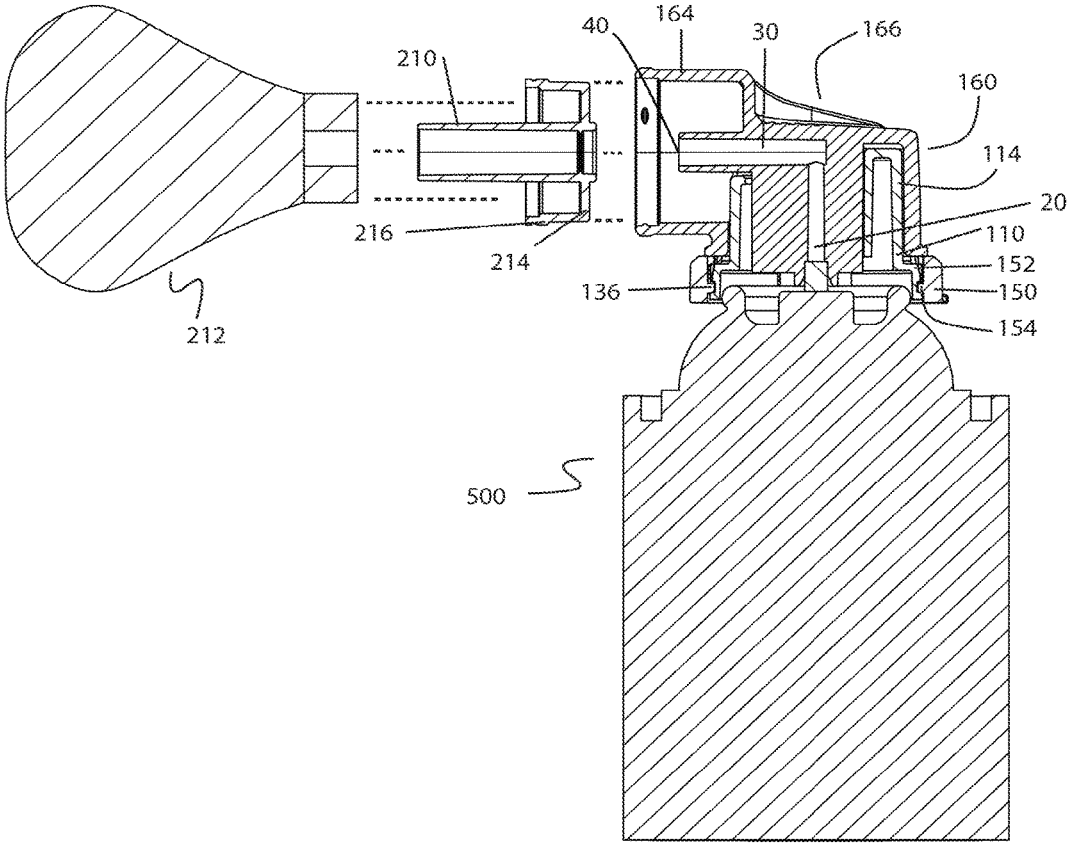
FIG. 10 is a longitudinal cross-section view of an example embodiment attached to a spray canister having a brush assembly illustrated attachable to a head member.
Figure 11:
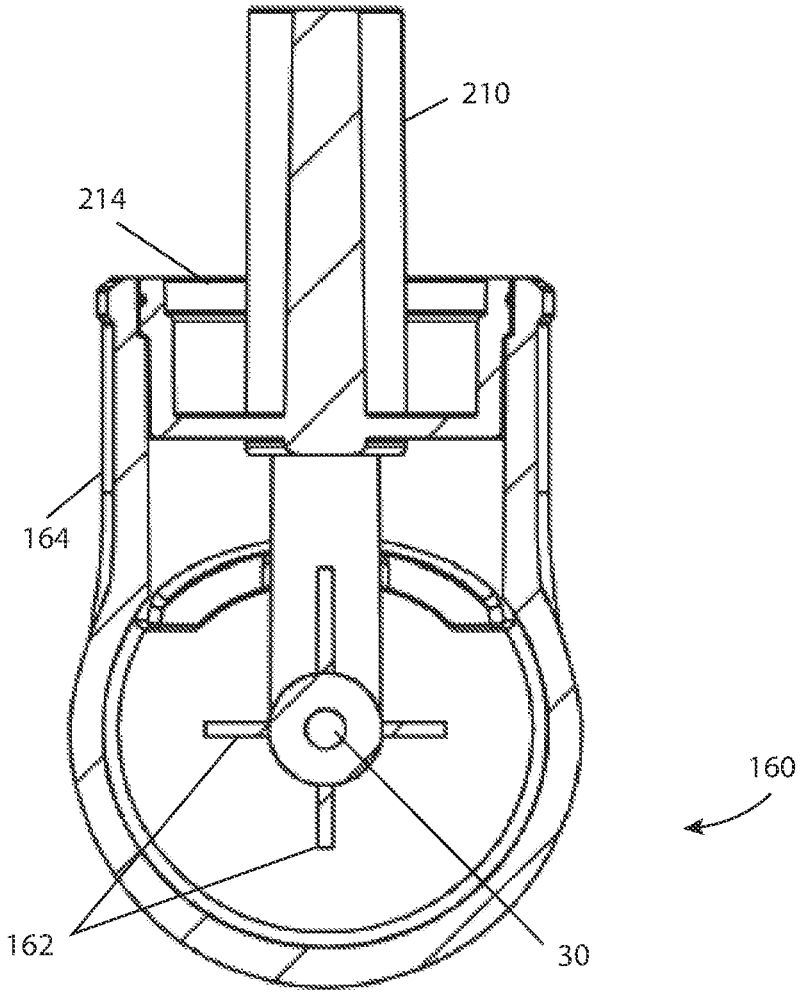
FIG. 11 is bottom elevation view of the head member.

With reference now to the drawings, and in particular FIGS. 1 through 10 thereof, example of the instant spray can attachable actuator and brush assembly employing the principles and concepts of the present spray can attachable actuator and brush assembly and generally designated by the reference number 10 will be described.

Referring to FIGS. 1 through 10 a preferred embodiment of the present spray can attachable actuator and brush assembly 10 is illustrated.

The present spray can attachable actuator and brush assembly 10 has been devised to enable expedient attachment to an aerosol canister 500 in place of an existing actuator (not shown), whereby discharge of a pressurized fluid interior the aerosol canister 500 is transferrable through an actuator assembly 100 and thence applicable to a targeted surface by action of a brush assembly 200 attached at the actuator assembly 100. Thus application of the fluid to a targeted surface is enabled by manual action applied to direct the brush assembly 200 in contact with said surface.

The present spray can attachable actuator and brush assembly 10 is configured for attachment to the valve stem 504 of any aerosol canister 500 whereby any existing aerosol canister 500 is convertible for use with the brush assembly 200 for application of the pressurized fluid to a targeted surface by manual action directing the brush assembly 200, as desired.

The actuator assembly 100, therefore, is attachable overtop a valve stem 504 of an aerosol canister 500. The actuator assembly 100 includes a vertically oriented central channel 20, disposed to position around the valve stem 504, and an interior channel 30 disposed for insertion into the central channel 20, said interior channel 30 disposed to sealably receive the valve stem 504. The interior channel 30 terminates at an outlet 40 outfacing from the actuator assembly 100. Thus fluid released through the valve stem 504 is communicable through the interior channel 30 for discharge out the outlet 40.

The brush assembly 200 is attachable to the actuator assembly 100 in open communication with the outlet 40. The brush assembly 200 includes an elongate nozzle 210 centrally disposed interior to a brush body 212, which elongate nozzle 210 is securable in open communication with the outlet 40. Thus, in broadest terms, depression of the actuator assembly 100 discharges fluid pressurized within the aerosol canister 500 for delivery into the brush body 212 for application to a surface or object. Application of fluid from the aerosol canister 500 is therefore controllable and applicable by manual action effective to direct the brush body 212, as desired, upon a surface or object.

Discussing now the actuator assembly 100. The actuator assembly 100 includes a seating member 110 surrounding the central channel 20. The seating member 110 is attachable atop the aerosol canister 500 by action of an attachment collar 150 exteriorly fittable circumferentially around a lower portion 112 of the seating member 110, said attachment collar 150 thereby effecting taut engagement of the seating member 110 to a neck 502 of the aerosol canister 500. A head member 160 is thence fittable overtop the seating member 110 to position the interior channel 30 into the central channel 20 and into engagement with the valve stem 504. The head member 160 therefore encloses the interior channel 30 therein and presents the outlet 40 outfacing therefrom. Manual action effective to depress the head member 160 thus concurrently effects depression of the valve stem 504 of the aerosol canister 500 whereby fluid pressurized within the aerosol canister 500 is deliverable through the interior channel 30, out the outlet 40, and into the brush assembly 200 there attached.

Discussing now the seating member 110. The seating member 110 includes a lower portion 112, attachable to a top of the aerosol canister 500, and an upper portion 114. The lower portion 112 includes a plurality of compressible hasp members 130 circumferentially disposed thereabouts. Each of the plurality of compressible hasp members 130 is compressible to frictionally engage against, and thus secure to, the aerosol canister 500 neck 502 when the attachment collar 150 is secured overtop thereof. The upper portion 114 is generally cylindrical and surrounds the central channel 20 therein. A top surface 118 is disposed atop the upper portion 114 and a seating connect 120 is radially disposed transversely in the top surface 118. The central channel 20 is vertically disposed in open communication with the seating connect 120 and terminates at a cruciate seat 122 and a securement channel 124 vertically disposed to likewise terminate at the top surface 118. The cruciate seat 122 and securement channel 124 are disposed to engage with the head member 160, and guide the interior channel 30 to engage with the valve stem 504, when the head member 160 is fitted overtop the seating member 110, as will be described subsequently.

The attachment collar 150 is thence fittable exteriorly to circumferentially engage around the lower portion 112 of the seating member 110 and position and secure said lower portion 112 to the neck 502 of the aerosol canister 500. The attachment collar 150 is sized appropriately to fit overtop the lower portion 112 and thereabouts compressively engage each of the plurality of compressible hasp members 130 frictionally against the underlying aerosol canister 500. Thus the attachment collar 150 enables securement of the lower portion 112 in position with the valve stem 504 disposed centrally interior to the central channel 20 in appropriate position and alignment for engagement by the interior channel 30 when the head member 160 is subsequently attached.

Each of the plurality of compressible hasp members 130 includes a compressible portion 132 and a foot portion 134. The compressible portion 132 is compressible between an uncompressed position and a compressed position. A track channel 136 is indented exteriorly upon the compressible portion 132 and a seating channel 138 is vertically disposed upon the foot portion 134, said seating channel 138 disposed to openly conjunct the track channel 136. The seating channel 138 and the track channel 136 are each disposed to slidingly receive each of a plurality of protuberances 154 perpendicularly projected from an interior surface 152 of the attachment collar 150.

Thus, the attachment collar 150 is fittable over the lower portion 112 such that each of the plurality of protuberances 154 slots into an associated seating channel 138. Rotation of the attachment collar 150 in a first direction thus translates each of the plurality of protuberances 154 into an associated track channel 136 whereby the compressible portion 132 of each compressible hasp member 130 is forcibly compressed towards the compressed position, by movement of each protuberance 154 along each track channel 136, and the lower portion 112 is thus forced to frictionally engage against the aerosol canister 500 to which the device 10 is attached.

Thus fit of the attachment collar 150 to the lower portion 112 of the seating member 110 is effective to secure the lower portion 112 in position when the attachment collar 150 is seated thereover and then rotated in the first direction effective from a seated position towards a farthermost position. Different sized canisters are therefore contemplated as securable to the same device because frictional engagement of each of the compressible hasp members 130 against the canister is effective when the compressible portion 132 is maximally compressed against the canister neck, as may occur at any position between the seated position and the farthermost position. Thus, for example, the attachment collar 150 secures the lower portion 112 to a wider canister in a position closer to the seated position relative to, say, a less wide canister, whereon the attachment collar 150 secures the lower portion 112 to the canister in a position rotated closer to the farthermost position.

Once the lower portion 112 is secured to the neck 502 of the aerosol canister 500, the head member 160 is attachable overtop the seating member 110 by engagement into the seating connect 120 without abutting the attachment collar 150 thereunder installed.

Discussing now the head member 160. The head member 160 includes the interior channel 30 which is thus disposed to impose into the central channel 20 when the head member 160 is fitted overtop the upper portion 114 of the seating member 110 and engage overtop the valve stem 504. A cruciate member 162 is disposed endwise bounding the interior channel 30 for receipt of the valve stem 504, said cruciate member 162 configured to superimpose into the cruciate seat 122 disposed in the seating member 110 top surface 118, and there engage by interconnection with the securement channel 124. The cruciate member 162 thus aligns and maintains flush integration of the interior channel 30 into the central channel 20 to therein mate with the valve stem 504 and effect conveyance of fluid therethrough when the aerosol canister 500 is depressurized by manual action applied thereto.

A cylindrical conduit 164 is disposed circumferentially surrounding the outlet 40 for interconnection with the brush assembly 200, as will be described subsequently. A flattened section 166 is generally horizontally disposed atop the head member 160 posteriorly located relative the cylindrical conduit 164. Manual depression of the flattened section 166 enables depression of the head member 160 to effect depressurization of the aerosol canister 500 to which the device 10 is attached.

Discussing now the brush assembly 200. The brush assembly 200 includes a brush attachment base 214 disposed for connection into the cylindrical conduit 164 and a brush body 212. The brush attachment base 214 includes a cylindrical seating section 216, disposed to connect into the cylindrical conduit 164 of the head member 160, and an elongate nozzle 210 disposed projected centrally from the cylindrical seating section 216. The elongate nozzle 210 is disposed to engage over the outlet 40 when the cylindrical seating section 216 is connected into the cylindrical conduit 164 of the head member 160. The brush body 212 is thence connectable to the elongate nozzle 210.

Thus fluid is dischargeable out the aerosol canister 500 when the head member 160 is manually depressed, said fluid dischargeable out the outlet 40 and into the brush body 212 for application by manual action effective to direct the brush body 212 to a targeted surface or object, as desired.

Additional embodiments contemplated as part of this invention include motorized means effecting oscillation and rotation of the brush body 212 and inclusion of a heating element 800 whereby the fluid discharged into the brush body 212 is heated thereby. In these alternate embodiments, a motor 700 is disposed to render rotation of the brush body 212. The motor 700 may be disposed interior to the cylindrical conduit 164, or alternately at the cylindrical seating section 216 of the brush attachment base 214. The heating element 800 may likewise be disposed, to effect heating of the elongate nozzle 210 whereby fluid discharged out the nozzle 210 may be appreciably warmed during travel through said nozzle 210. The heating element 800 may likewise be disposed in the actuator assembly 100 whereby depression of the head member 160 activates the heating element 800 and the fluid is heated while traveling through the interior channel 30.

What is claimed is:

1. A spray can attachable actuator and brush assembly comprising:

an actuator assembly attachable overtop a valve stem of an aerosol canister, said actuator assembly having:

a vertically oriented central channel disposed to position sealably overtop the valve stem;

an interior channel disposed in open communication with the central channel, said interior channel terminating at an outlet outfacing from the actuator assembly; and a brush assembly attachable to the actuator assembly, said brush assembly including an elongate nozzle centrally disposed interior to a brush body, said elongate nozzle thereat securable in open communication with the outlet;

wherein depression of the actuator assembly discharges a fluid pressurized within the aerosol canister for delivery into the brush body for application to a surface or object, whereby application of said fluid from the aerosol canister is controllable and applicable by manual action effective to direct the brush body.

2. The spray can attachable actuator and brush assembly of claim 1 wherein the actuator assembly further comprises:

a seating member attachable atop the aerosol canister, said seating member surrounding the central channel;

an attachment collar exteriorly fittable circumferentially around the seating member, said attachment collar effecting taut engagement of the seating member to a neck of the aerosol canister; and a head member attachable overtop the seating member, said head member enclosing the interior channel therein and presenting the outlet outfacing therefrom, said head member fittable into the seating member to position the interior channel imposed into the central channel for engagement with the valve stem;

wherein depression of the head member depresses the valve stem of the aerosol canister whereby fluid pressurized within the aerosol canister is deliverable through the interior channel, out the outlet, and into the brush assembly there attached.

3. The spray can attachable actuator and brush assembly of claim 2 wherein the brush assembly further comprises a brush attachment base connectable into the head member.

4. The spray can attachable actuator and brush assembly of claim 3 wherein the seating member further comprises:

a lower portion attachable atop the aerosol canister to position said valve stem interior to the central channel;

an upper portion surrounding the central channel;

a top surface disposed atop the upper portion;

a seating connect radially disposed transversely in the top surface, said seating connect including a cruciate seat and a securement channel; and a plurality of compressible hasp members circumferentially disposed around the lower portion, each of said plurality of compressible hasp members having a plurality of track channels inset exteriorly thereon;

wherein the attachment collar engages into each of the plurality of track channels to effect compression of each of the plurality of compressible hasp members securely against the neck of the aerosol canister when said attachment collar is rotated in a first direction; and wherein the head member securely seats into the seating connect by engagement with the cruciate seat and securement channel to position the interior channel into the central channel for conveyance of fluid depressurized from the canister therethrough.

5. The spray can attachable actuator and brush assembly of claim 4 wherein the head member further comprises:

a cylindrical conduit disposed around the outlet; and a flattened section disposed posteriorly atop the head member;

wherein the brush attachment base interconnects interiorly into the cylindrical conduit to align and maintain mating engagement between the elongate nozzle and the outlet whereby a user may effect depression of the head member, and thus depressurization and release of fluid from the aerosol canister, by manual action upon the flattened section to discharge said fluid into the brush body.

6. The spray can attachable actuator and brush assembly of claim 5 wherein the head member further comprises a cruciate member endwise bounding the interior channel, said cruciate member disposed to superimpose into the cruciate seat disposed in the seating member top surface to engage by interconnection with the securement channel and there align and maintain flush integration of the interior channel within the central channel for conveyance of fluid therethrough when the aerosol canister is depressurized by manual action at the flattened section of the head member.

7. A spray can attachable actuator and brush assembly comprising:

an actuator assembly attachable in actionable communication with a valve stem of an aerosol canister, said actuator assembly comprising:

a seating member having:

a lower portion attachable to a neck of the aerosol canister;

an upper portion;

a top surface disposed atop the upper portion;

a seating connect radially disposed transversely in the top surface, said seating connect including a cruciate seat and a securement channel;

a central channel vertically disposed in open communication with the seating connect, said central channel configured to seat over the valve stem of the aerosol canister for directional conveyance of fluid releasable from the aerosol canister when the valve stem is depressed;

an attachment collar fittable exteriorly circumferentially around the lower portion of the seating member to position and secure said lower portion to a neck of the aerosol canister;

a head member attachable overtop the seating member, said head member attachable atop the seating member by engagement into the seating connect without abutting the attachment collar there installed, said head member having:

an interior channel disposed to impose into the seating member central channel and engage with the valve stem, said interior channel disposed with an outlet outfacing from the head member;

a cylindrical conduit disposed circumferentially surrounding the outlet;

a flattened section atop the head member, said flattened section disposed posteriorly relative the cylindrical conduit;

a brush assembly attachable to the actuator assembly, said brush assembly comprising:

a brush attachment base connectable into the cylindrical conduit, said brush attachment base having:

a cylindrical seating section disposed to connect into the cylindrical conduit of the head member;

an elongate nozzle disposed projected centrally from the cylindrical seating section, said elongate nozzle disposed to engage over the interior channel outlet when the cylindrical seating section is connected into the cylindrical conduit of the head member; and a brush body disposed connectable to the elongate nozzle;

wherein the actuator assembly is attachable to the aerosol canister and the brush assembly is attachable to the actuator assembly whereby manual engagement of the head member enables depression of the head member to contact the attachment collar and depress the valve stem seated in fluid communication with the central channel interior to the seating member, enabling fluid pressurized interior to the aerosol canister to be conveyed out the elongate nozzle for application upon a surface or object by manual direction of the brush body there attached.

8. The spray can attachable actuator and brush assembly of claim 7 wherein the lower portion of the seating member further comprises a plurality of compressible hasp members circumferentially disposed around the seating member lower portion, said plurality of compressible hasp members compressible to secure to the aerosol canister neck when the attachment collar is secured overtop thereof.

9. The spray can attachable actuator and brush assembly of claim 8 wherein the head member further comprises a cruciate member endwise surrounding the interior channel, said cruciate member disposed to fit into the cruciate seat of the seating member and securely engage into the securement channel therein.

10. The spray can attachable actuator and brush assembly of claim 9 wherein each of the plurality of compressible hasp members includes a compressible portion and a foot portion, said compressible portion compressible from an uncompressed position to a compressed position.

11. The spray can attachable actuator and brush assembly of claim 10 wherein each of the plurality of compressible hasp members further includes a track channel indented exteriorly upon the compressible portion and a seating channel disposed vertically upon the foot portion.

12. The spray can attachable actuator and brush assembly of claim 11 wherein the attachment collar includes a plurality of protuberances perpendicularly disposed upon an interior surface thereof, each of said plurality of protuberances devised to slot into each seating channel and position securely engaged along each track channel of each of the plurality of compressible hasp members, when the attachment collar is seated over the lower portion and rotated in a first direction, whereby rotation of the attachment collar between a seated position and a farthermost position effects compression of each of the compressible hasp members to secure the seating member in position around the neck of the aerosol canister.

13. The spray can attachable actuator and brush assembly of claim 12 further including a motor disposed to enable rotation of the brush body when the aerosol canister is depressurized.

14. The spray can attachable actuator and brush assembly of claim 13 further including at least one heating element disposed to heat fluid discharged from the aerosol canister previous to application from the brush body.

* * * * *